US005525045A

United States Patent [19]

Jang

[11] Patent Number: 5,525,045

[45] Date of Patent: Jun. 11, 1996

[54] RECIPROCATING COMPRESSOR

[75] Inventor: Geun-Sik Jang, Seoul, Rep. of Korea

[73] Assignee: Samsung Electronics Co., Ltd., Suwon, Rep. of Korea

[21] Appl. No.: 258,581

[22] Filed: Jun. 10, 1994

[30] Foreign Application Priority Data

Jun. 11, 1993 [KR] Rep. of Korea ..... 93-10232

[51] Int. Cl.[6] ..... F04B 49/00

[52] U.S. Cl. ..... 417/284

[58] Field of Search ..... 417/284, 297, 417/298

[56] References Cited

U.S. PATENT DOCUMENTS 1,489,912 4/1924 Winkler ..... 417/284 X
1,663,687 3/1928 Down ..... 417/298
3,523,745 8/1970 Rich ..... 417/284
3,884,597 5/1975 Ito ..... 417/284

FOREIGN PATENT DOCUMENTS 2-3082 1/1990 Japan .
2-76181 6/1990 Japan .

*Primary Examiner* Richard E. Gluck
*Attorney, Agent, or Firm* Burns, Doane, Swecker & Mathis

[57] ABSTRACT

A compressor includes a reciprocating piston mounted in a cylinder for sucking-in refrigerant gas during a retraction stroke and then compressing and discharging the gas during a compression stroke. A front wall of the piston includes a through-hole, and carries a spring-biased closure for closing the through-hole. The closure can be opened counter to the spring force by the presence of an excessive pressure in front of the piston, in order to relieve that pressure. The closure projects forwardly beyond the piston front wall so as to also open the through-hole upon contacting an end plate of the cylinder during a compression stroke.

6 Claims, 5 Drawing Sheets

RECIPROCATING COMPRESSOR

BACKGROUND OF THE INVENTION

1. Field of the Invention

The present invention relates to a reciprocating compressor, and more particularly to a reciprocating compressor for increasing volumetric efficiency and compression efficiency of a compressor and for reducing fatigue phenomenon of the compressor by decreasing re-expansion of high pressure refrigerant by exhausting high pressure refrigerant gas existing in an allowance space of a cylinder. High pressure refrigerant is also exhausted when liquid refrigerant exists in the cylinder to prevent over pressure at an initial operation of the compressor.

2. Description of the Prior Art

Generally speaking, a reciprocating compressor, as illustrated in FIG. 1, has a construction disposed with a driving unit 1 and a compression unit 2 within an airtight vessel 100, where the driving unit 1 comprises a motor.

The motor comprises a rotor 120 and a stator 130, where the rotor has a rotating shaft 110.

The compressing unit 2 comprises: an eccentric shaft 212 coupled eccentrically to a lower end of the rotating shaft 110, a connecting rod 214 rotatively coupled to the eccentric shaft 212; a piston 210 rotatively coupled to the connecting rod 214; a circular cylindrical cylinder 200 containing the reciprocating piston 210; and a valve plate 230 and a head cover 220 coupled to one side of the cylinder 200.

The reciprocating compressor thus constructed is commonly installed on a refrigerator, air conditioner and the like to suck in circulating refrigerant gas, and discharge the gas in a high pressure and high temperature state.

When the motor comprising the rotor 120 and the stator 130 is input with electric power, the rotor 120 is rotated to rotate the rotating shaft 110.

When the rotating shaft 110 is rotated, the eccentric shaft 212 is rotated, and when the eccentric shaft 212 is rotated, the crank shaft 214 reciprocates.

When the crank shaft 214 reciprocates, the piston 210 reciprocates linearly within the cylinder 200.

When the piston 200 reciprocates within the cylinder 200, the refrigerant gas circulating in the vessel 100 is sucked into the cylinder 200 to thereby be compressed to a high pressure and high temperature state, and be discharged to the outside of the cylinder 200.

FIG. 2 is a sectional drawing for illustrating an enlarged construction of the compression unit 2 in the reciprocating compressor thus described.

The compressing unit 2 comprises: the eccentric shaft 212 coupled eccentrically to the lower end of the rotating shaft 110; the connecting rod 214 rotatively coupled to the eccentric shaft 212; the piston 210 rotatively coupled to the connecting rod 214; the cylindrical cylinder 200 for reciprocating the piston 210; the valve plate 230 coupled to one side of the cylinder 200; and the head cover 220.

Meanwhile, the cylinder has a circular cylindrical shape open on both sides, and the piston 210 can be inserted into one side of the cylinder 200 and the valve plate 230 and head cover 220 are coupled to the other side of the cylinder 200.

The head cover 220 is partitioned into a suction chamber 221 and a discharge chamber 222 by a bulkhead 223, and the valve plate 230 is disposed with a suction port 231 penetrating the cylinder 200 and the suction chamber 221, and a discharge port 232 and the cylinder 200 penetrating the discharge chamber 222.

The suction port 231 and the discharge port 232 are disposed with a suction valve 232 and a discharge valve 234 respectively.

In the conventional compressor thus constructed, as illustrated in FIG. 2*a*, the eccentric shaft 212 of the compressor 2 rotates to retract the piston 210 according as the rotating shaft of the motor rotates.

According as the suction value 233 is opened and the discharge valve 234 is closed, the refrigerant gas (in low temperature and low pressure state) in the suction chamber 221 is flowed into the cylinder 200.

Meanwhile, as illustrated in FIG. 2*b*, when the piston 210 is advanced, the suction valve 233 is closed, and when the discharge valve 234 is opened, the refrigerant gas in the cylinder 200 is compressed to the high pressure and high temperature state, and the compressed refrigerant gas is discharged to the discharge chamber 222 through the discharge port 232.

Even though the refrigerant gas is compressed by the maximum advancement of the piston into the cylinder 200 in the above-indentified process, there still remains an allowance space for the compressed refrigerant gas in the cylinder 200 between the piston 210 and the valve plate 230, which is called an allowance volume V.

The allowance volume V is generated to give an allowance niche between a front of the piston 210 and the valve plate 230 in order to prevent the front of the piston 210 from colliding with the valve plate 23 of the cylinder 200 or to prevent the over-compression from occurring.

Furthermore, the allowance volume V can also be determined by the volume or the like occupied by the discharge port 232 disposed on the valve plate 230.

However, because the suction and discharge processes of the refrigerant gas occur in an instant, and the refrigerant gas remaining in the allowance volume V is re-expanded in a partial discharge state during the suction process right after the discharge of the refrigerant gas, the effective volume within the cylinder 200 is reduced that much to thereby decrease the refrigerant gas volume which is sucked in.

In the aforesaid description, volume loss resulting from the reexpansion of the refrigerant gas which has remained in the allowance volume V is represented by region between points "V1'- V1" in FIG. 6.

In FIG. 6, the region between points "V2 - V1" denotes theoretical effective volume in case of no reexpansion, while "V2 - V1" denotes an effective volume in case of the reexpansion for an actual cycle.

Accordingly, the suction volume of the refrigerant gas is reduced to relatively decrease the discharged volume thereupon, so that compression efficiency of the compressor goes down.

Furthermore, if residual refrigerant in a liquid state remains in the cylinder 200 at the initial operation of the compressor, the over pressure is generated. In the absence of preventive measures, there arises a problem in that the fatigue phenomenon resulting from the over pressure gets worse.

For example in Japanese laid open utility model Publication No. 2-76181 entitled, "Reciprocating Compressor, a technique is disclosed wherein an orifice always interconnecting an interior of a cylinder and a low pressure side of an exterior of the cylinder in a reciprocating compressor, the compressor being similar to that described above, wherein gas is sucked into the cylinder by the reciprocating motion of a piston disposed within the cylinder, and simultaneously the gas is compressed to thereby be discharged.

According to the Japanese laid open utility model Publication No. 2-76181 the reexpansion of refrigerant compressed at high pressure, or the generation of over pressure of the refrigerant at the initial operational stage caused by residual liquid refrigerant can be prevented.

However, the Japanese laid open utility model application No. Hei 2 - 76181 involves a problem in that the compression efficiency can be markedly decreased because an interior of the cylinder and an exterior of the cylinder are always open therebetween.

Furthermore, in a Japanese laid open utility model application No. Hei 2 (1990) - 3082 entitled "piston device of compressor," there is described a compressor comprising a cylinder; a piston reciprocating within the cylinder; and a piston ring contacting an inner wall of the cylinder fitted into a ring groove disposed on an outer side of the piston. Also described therein is a technique where a piercing port for communicating with the ring groove and a cylinder inner socket is disposed at a rear end side of the piston ring, and a hole is formed within the ring groove on a side thereof where the piston ring is contacted.

According to the Japanese laid open utility model application No. Hei 2 - 3082, it seems that the refrigerant gas infused into the ring groove is discharged toward a low pressure side through the hole during a compression stroke to thereby prevent to a degree over compression caused by the liquid refrigerant infused into the cylinder during the initial operation. However, there remains a problem in that a decrease of compression efficiency cannot be avoided that is caused by the reexpansion of the compressed refrigerant gas still remaining in the allowance space.

SUMMARY OF THE INVENTION

The present invention is provided to overcome the aforementioned disadvantages, and it is an object of the present invention to provide a reciprocating compressor for decreasing the reexpansion of the high pressure refrigerant gas extant in the cylinder to thereby improve the volumetric efficiency for improvement of compression efficiency thereof, and for discharging to within a vessel disposed an outside of the cylinder part of the refrigerant gas within the cylinder when pressure in the cylinder is excessively increased, so that the over compression caused by compression of the liquid refrigerant extant in the cylinder during an initial operation of the compressor can be prevented to thereby decrease fatigue phenomenon of the compressor as well.

In accordance with the object of the present invention, there is provided a reciprocating compressor formed with a valve on a frontal area of a piston for discharging to a vessel disposed at an outside of the cylinder refrigerant gas still remaining in an allowance space between the piston and a valve plate of the valve during compression of the refrigerant gas in the cylinder, and for discharging to the outside of the cylinder part of the refrigerant gas by opening the valve through the pressure thereof when the pressure within the cylinder is excessively increased.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE PREFERRED EMBODIMENTS OF THE INVENTION

Hereinafter, preferred embodiments of the present invention will be described in detail with reference to the accompanying drawings.

Figure 1:
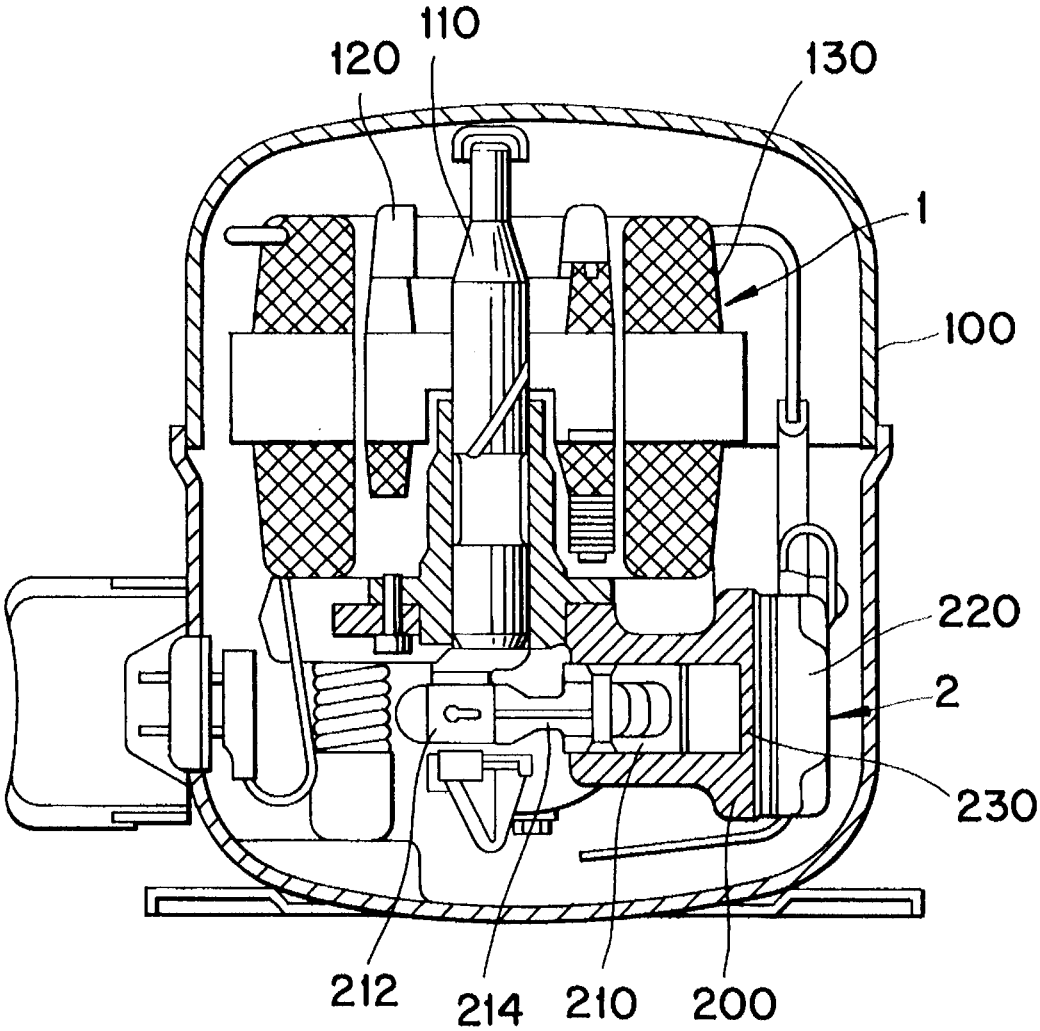
FIG. 1 (PRIOR ART)
FIG. 1 is a front sectional view of a conventional compressor.
Figure 2A:
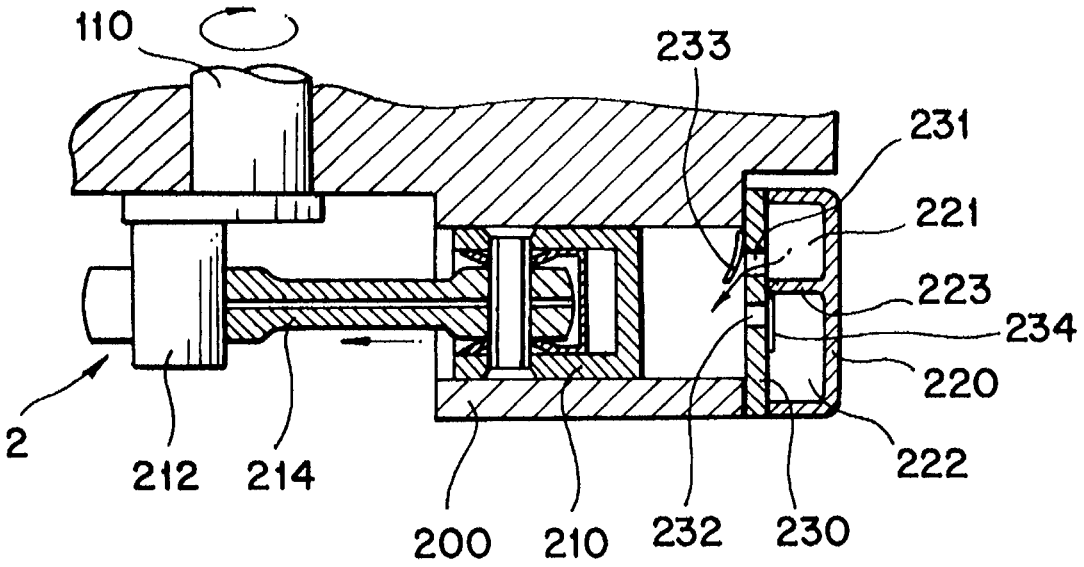
FIG. 2(a) (PRIOR ART)
FIGS. 2*a* and 2*b* are front sectional views for illustrating suction and discharge strokes of the refrigerant gas in the conventional reciprocating compressor.
Figure 2B:
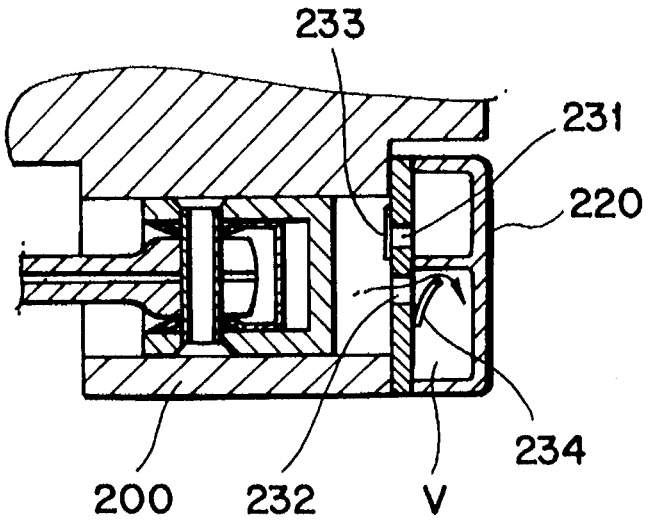
FIG. 2(b) (PRIOR ART)
Figure 3:
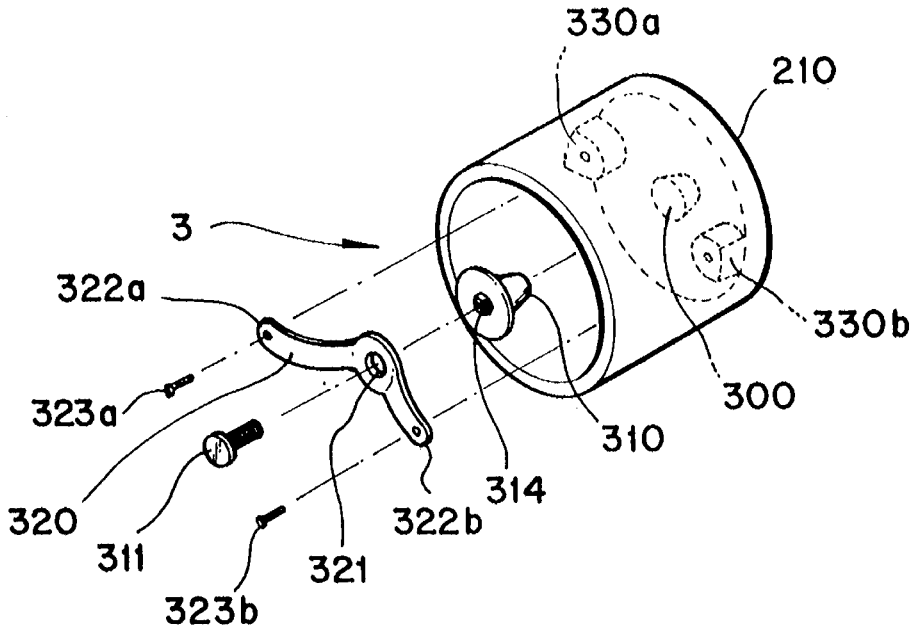
FIG. 3 is an exploded perspective view of a piston in a reciprocating compressor according to a first embodiment according to the present invention.

FIG. 3 is an exploded perspective view of a piston 210 comprising a compression unit in a reciprocating compressor according to the embodiment of the present invention, where a valve 3 is fastened to the piston 210. A central front of the piston 210 is formed with a conical hole 300 around which fastening holes 330*a* and 330*b* are disposed on both sides of an inner piston 210.

The valve 3 includes a lid or closure 310 for opening and closing the hole formed on the central front of the piston 210 and a resilient member 320 for tightly closing the lid to the hole 300.

Meanwhile, a tip of the lid 310 is formed lengthwise in order to be protruded to the front through the hole 300 of the piston 210, and the lid 310 and the hole 300 are conically shaped in order for the lid 310 to move only towards the rear, lest the lid should move toward the piston to thereby slip off.

Adjacent both ends of the resilient member 320 comprising the valve 3 are fastening members 330 and 330*b* formed on the piston 210. The resilient member includes fastening pieces 322*a* and 322*b* facing respective members 330, 330*b*.

A hole 321 is formed at a central area of the resilient member 320 and a fastening hole 314 is formed at a central lid.

A bolt 311 is fastened to the fastening hole 314 of the lid 310 through the hole 321 of the resilient member 320 to thereby fix the lid 310 to the resilient member 320.

The resilient member 320 is fastened to the fastening members 330*a* and 330*b* of the piston 210 by fastening bolts 323*a* and 323*b*.

The resilient force of the resilient member 320 is below the excessive compression force, so the lid can be retracted by the compression force during the excessive compression to thereby open the hole 300 formed in the central piston 210.

The suction and discharge strokes of the piston of the present invention thus constructed will be explained with reference to drawings 4*a*, 4*b* and 4*c*.

Figure 4A:
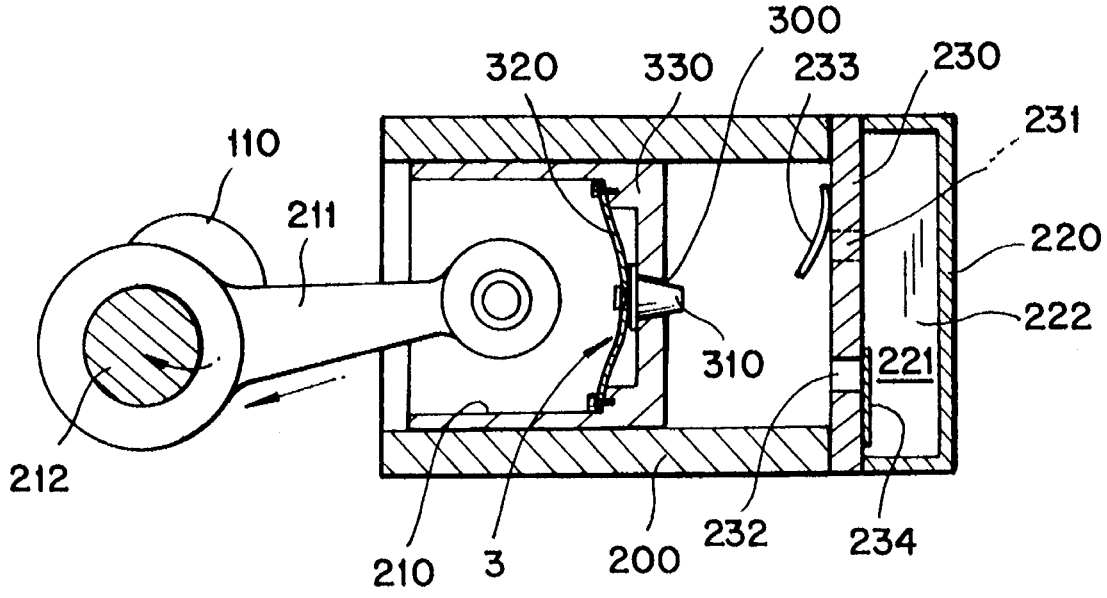
FIGS. 4*a*, 4*b* and 4*c* are sectional views illustrating suction and discharge strokes of the refrigerant gas in the reciprocating compressor according to the first embodiment in the present invention.
Figure 4B:
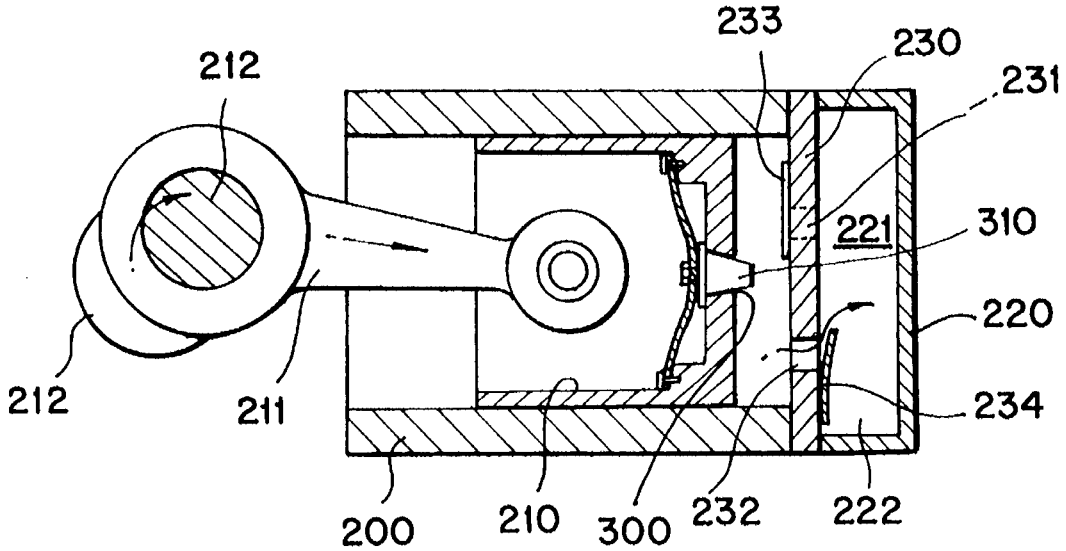
Figure 4C:
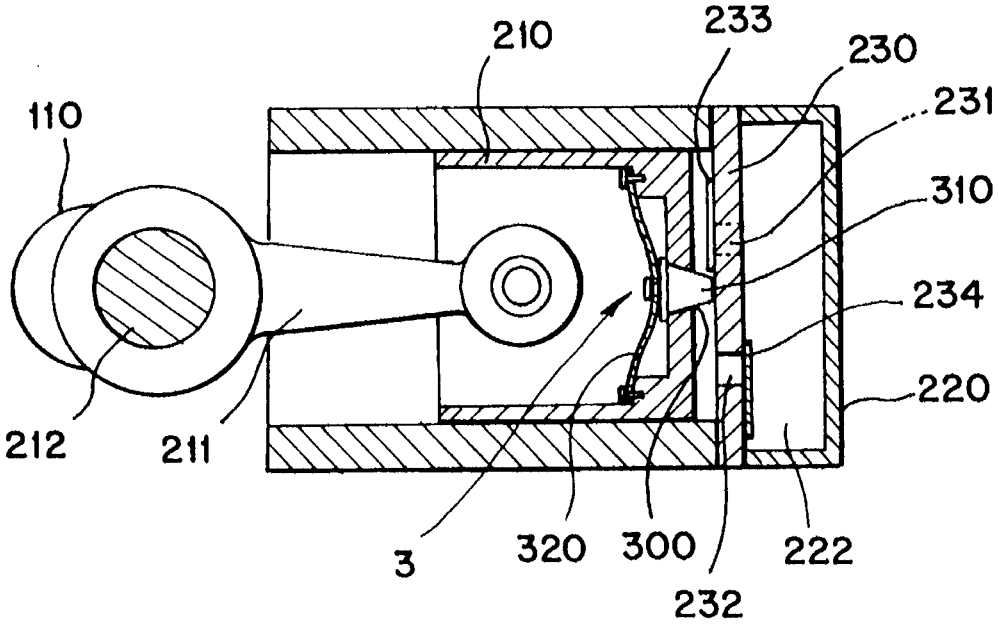

The FIGS. 4*a*, 4*b* and 4*c* are plane sectional views of the compression unit where the suction chamber (not shown) is disposed abreast of the discharge chamber 222, and is separated therefrom by a wall 221.

As per FIG. 4*a*, when the rotating shaft 110 is rotated by rotation (drive) of a motor, the eccentric shaft 212 is rotated to thereby retract the connecting rod 211 and the piston 210.

When the piston is retracted within the cylinder 200, a suction valve 233 is opened to cause the refrigerant gas in the suction chamber to be infused into the cylinder 200 through the suction port 231.

Then, as per FIG. 4*b*, when the rotating shaft is kept rotating, the connecting rod 211 and the piston 210 are advanced by the rotation of the eccentric shaft 212 to thereafter compress the refrigerant gas sucked into the cylinder 200.

When the refrigerant gas in the cylinder 200 is compressed to a high pressure and high temperature state by the piston, the discharge valve 234 is opened by the pressure thereof and the refrigerant gas is discharged into the discharge chamber 222 through a discharge port 232.

However, when an over pressure occurs, the lid 310 is resilently pushed back (retracted) toward the rear by the excessive compression force.

When the hole 300 is opened by the retraction of the lid 310, the refrigerant gas compressed according to the opening of the hole 300 is discharged into the vessel located outside of the cyliner 200.

At this time, the low pressure refrigerant gas contained in the vessel 100, along with the refrigerant gas discharged from the cylinder 200 by the excessive compression, is in turn infused into the suction chamber disposed on the rear (on the drawing) of the discharge chamber 222.

Meanwhile, as illustrated in FIG. 4C, when the piston is advanced to get closer to the valve plate 230, the tip of the lid 310 contacts the valve plate 230, and the lid 310 is retracted by contained advance of the piston 210, against the resilient force of the resilient member 320, which causes the hole 300 to be open. The high pressure refrigerant gas disposed in the allowance space V without being discharged through the discharge port 232 is then discharged into the vessel 100.

Accordingly, as illustrated in FIG. 4*a*, the suction quantity is not decreased when the piston 210 in the cylinder 200 is retracted to thereby suck in the refrigerant gas in the suction chamber.

In other words, the suction and discharge strokes illustrated in FIGS. 4*a*, 4*b* and 4*c* are realized continuously and instantly when the compressor is operated.

Figure 6:
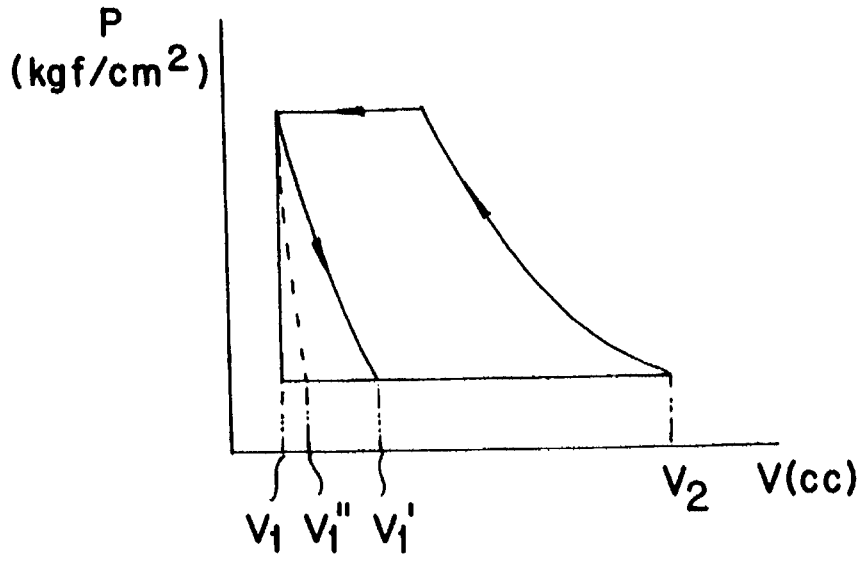
FIG. 6 is a group of a P-V curve of the compressor.

According as the refrigerant gas sucked into the cylinder 200 is discharged to the discharge chamber 222 through the discharge port 232, and as the high pressured refrigerant gas disposed in the allowance space V is discharged into the vessel through the port 310, the suction quantity and discharge quantity are not decreased because the suction quantity is fully sucked in during the suction stroke of the refrigerant gas following the discharge stroke, which is illustrated as "V2 - V1" on the P - V line in FIG. 6, where "V1" is volume minus the reexpansion.

Figure 5:
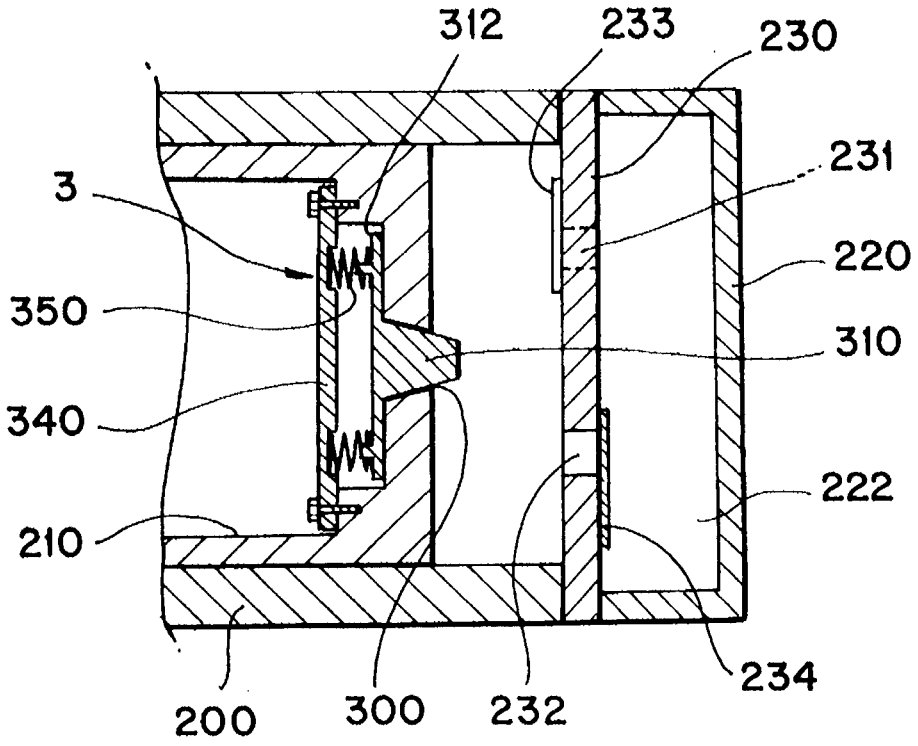
FIG. 5 is an enlarged sectional view of the compression unit according to a second embodiment in the present invention.

FIG. 5 is an enlarged sectional view of the compression unit according to an example of another embodiment in the present invention where an assembled state of the compression comprising the piston, cylinder, head cover and valve plate is illustrated.

According to FIG. 5, the hole 300 is formed on the central front of the piston 210 and a press plate 312 is formed at the rear of the lid 310 on the valve for opening and closing the hole 300.

A fixing plate 340 is disposed on an inner area of the piston 210, away from the press plate 312 at a predetermined distance, and a plurality of coil springs 350 are assembled together between the press plate 312 and the fixing plate 340.

The coil spring 350, like the resilient member 320 stated in FIG. 4, has less resilience than the excessive compression force.

In the example of this other embodiment according to the present invention thus constructed, operation and effect thereof are the same as those illustrated in FIG. 4, wherein, the lid 310 is opened overcoming the resilience of the coil spring 350 when the excessive compression occurs, to thereby discharge the refrigerant gas of high pressure to the vessel through the hole 300.

Meanwhile, when the piston 210 is advanced during the discharge of the refrigerant gas to get close to the valve plate 230, the tip of the lid 310 comes to contact the valve plate 230, and the lid 310 is retracted by the continuous advance of the piston 210.

When the lid 310 is retracted, the coil spring 350 is pressed to thereby open the hole 300, so that most of the refrigerant gas disposed in the allowance volume V is discharged.

As seen from the foregoing, when the piston 210 is advanced to the maximum, the lid 310 for closing the hole 300 is pressed by the valve plate 230 to discharge the high pressure refrigerant gas disposed in the allowance volume V through the hole 300, so that the reexpansion volume can be decreased.

When the reexpansion volume is decreased as described above, the refrigerant gas which can be then sucked in is increased in the same quanity as the quantity decreased in the reexpansion volume to thereby improve the compression efficiency of the compressor.

Furthermore, in case the liquid refrigerant is infused into the cylinder during the initial operation of the compressor, the excessive (over) compression occurs, during which time, the lid of the valve is opened to discharge the over compressed refrigerant gas through the hole 300, so that the fatigue phenomenon resulting from the increase of compression load in the compressor can be decreased.

The foregoing description and drawings are illustrative and are not to be taken as limiting.

Still other variations and modifications are possible without departing from the spirit and the scope of the present invention.

Specifically, in the above embodiments, although construction is so made to have one hole formed on the contral front of the piston to cause the hole to be closed by the valve, it should be noted that the present invention may be irrelevant as to the number of the holes.

What is claimed is:

1. A reciprocating compressor for refrigeration system, comprising:

a casing forming a cylinder having a gas inlet, a gas outlet, and an end wall;

a piston reciprocally mounted in said cylinder for sucking-in refrigerant gas through said gas inlet during a piston retraction stroke and for compressing and discharging the sucked-in gas through said gas outlet during a piston compression stroke, said piston including a front wall facing said end wall and having a frusto-conically shaped through-hole formed therein;

a closure yieldably biased into closing relationship with said through-hole with a closing force such that a retraction of said closure out of said closing relationship causes an area in front of said piston to be communicated with an area behind said piston through said through-hole, said closure projecting forwardly beyond said front wall for contacting said end wall while said front wall is spaced rearwardly from said end wall; and a resilient member disposed behind said front wall for generating said closing force, said resilient member comprising a resilient plate mounted on said piston.

2. A compressor according to claim 1, wherein said end wall carries said gas inlet and said gas outlet.

3. A compressor according to claim 1, wherein said closing force is of a magnitude permitting said closure to be moved out of said closing relationship in response to a predetermined gas pressure in front of said piston.

4. A compressor according to claim 1, wherein said closure is of generally forward tapering frusto-conical shape.

5. A compressor according to claim 1, wherein said closure is attached to said resilient plate.

6. A compressor according to claim 1, wherein said resilient plate has opposite ends connected to said piston such that a center region of said plate is movable toward and away from said through-hole, said closure being attached to said center region.

* * * * *